US007028987B2

(12) United States Patent
Wanner

(10) Patent No.: US 7,028,987 B2
(45) Date of Patent: Apr. 18, 2006

(54) LIFTING JACK ARRANGEMENT FOR LIFTING PLATFORMS

(75) Inventor: Hubert Wanner, Haldenwang (DE)

(73) Assignee: MAHA Maschinenbau Haldenwang GmbH & Co. KG, (DE)

( * ) Notice: Subject to any disclaimer, the term of this patent is extended or adjusted under 35 U.S.C. 154(b) by 266 days.

(21) Appl. No.: 10/366,927

(22) Filed: Feb. 13, 2003

(65) Prior Publication Data

US 2003/0155561 A1 Aug. 21, 2003

(30) Foreign Application Priority Data

Feb. 15, 2002 (DE) ..... 202 02 362 U

(51) Int. Cl.
*B66F 7/28* (2006.01)

(52) U.S. Cl. ..... 254/93 L; 254/89 H

(58) Field of Classification Search ..... 254/89 H, 254/93 R, 93 H, 93 L, 6 B, 2 B, 2 C
See application file for complete search history.

(56) References Cited

U.S. PATENT DOCUMENTS 3,970,171 A * 7/1976 Honecker et al. ..... 187/234
5,259,482 A * 11/1993 Proulx et al. ..... 187/205
5,501,296 A * 3/1996 Fletcher ..... 187/210
5,860,491 A * 1/1999 Fletcher ..... 187/203

FOREIGN PATENT DOCUMENTS

| | | |
|---|---|---|
| DE | 1 965 364 | 8/1967 |
| DE | 6610015 | 1/1973 |
| DE | 200 03 062 | 7/2000 |
| DE | 201 06 513 | 9/2001 |

OTHER PUBLICATIONS

Gleitlager, Wartungsfreie Dauerläufer, FORDERMITTELJOURNAL, p. 43, (Sep. 1995).

* cited by examiner

*Primary Examiner*—Lee D. Wilson
(74) *Attorney, Agent, or Firm*—The Maxham Firm

(57) ABSTRACT

A lifting jack arrangement for lifting platforms. The lifting jack has a liftable and lowerable, dimensionally stable guide tube on the upper end of which support elements, for example for a motor vehicle, can be mounted. A driving unit would typically be coupled with the guide tube for lifting and lowering it. A stationary guiding sleeve has sliding elements which are in contact with the guide tube. The guide tube is coated with a reduced-friction, abrasion resistant sliding layer consisting of a permanently adhering synthetic material containing PTFE.

16 Claims, 1 Drawing Sheet

LIFTING JACK ARRANGEMENT FOR LIFTING PLATFORMS

BACKGROUND OF THE INVENTION

1. Field of the Invention

The present invention relates to a lifting jack arrangement for lifting platforms for vehicles.

2. Discussion of Related Art

Such lifting jack arrangements are preferably used for under-floor motor vehicle lifting platforms comprising one or more jacks. Each lifting jack comprises a dimensionally stable steel tube having a circular or polygonal cross-section which is guided in a sleeve, usually arranged at floor level. The sleeve is vertically moved from an initial position at floor level into an elevated operational position by suitable lifting means, usually a hydraulic cylinder positioned inside the tube.

A support construction for the vehicle to be lifted, which may comprise flat drive-on supports with swiveling telescope arms provided with carrying elements at their ends or the like, is attached to the upper end of the guide tube. In such lifting jack arrangements the outer sliding surfaces of the guide jacks which interact with the sliding elements in the sleeves are typically hard chromium plated to perpetuate the required sliding properties over several years of use. To obtain the required permanent attachment of the chromium layer and to prevent wear of the sliding surfaces, first a thin metal layer, for example nickel, is applied to the outer surfaces of the guide jacks before the hard chromium layer is applied by known methods. However, such a coating is technically complicated and expensive.

SUMMARY OF THE INVENTION

It is one object of the invention to provide an improved lifting jack arrangement, where the manufacturing expenses and costs are reduced as compared to known arrangements while providing at least the same operational features.

According to an embodiment of the invention the stated object is accomplished by coating the guiding tube with a reduced-friction and abrasion resistant sliding layer consisting of a permanently adhering synthetic material containing PTFE, for example.

In practice it has been found that a sliding layer consisting of a hard synthetic material containing PTFE and having a thickness of only a few hundredths of a millimeter can be produced at substantially lower costs than the known, chrome plated guide tube. In addition, due to the known excellent sliding properties of PTFE, lower friction values can be obtained even after an outstandingly large number of lifting and lowering movements of the guide tube under load, which corresponds to a sufficiently long operating time.

An extremely low wear of the paired sliding surfaces can be obtained when the sliding elements integrated in the stationary guide sleeve are formed of a dimensionally stable, hard synthetic material, in particular, on a polyethylene or a polyamide basis.

For obtaining a highly solid, durable and continuous connection of the sliding layer of the synthetic material to the steel guide tube, it is efficient to thoroughly clean the surface of the guide tube and to roughen it, for example, by sandblasting, before the reduced-friction layer is applied to the tube surface. The sliding layer may be applied, for example, as a liquid film. To solidify the sliding layer itself and to promote its binding to the roughened undersurface, the sprayed-on coating material is subjected to a heat treatment in an oven at about 200 to 250° C. together with the adjacent steel parts. The layer thickness of the hardened slide coating will then be about 10 μm to about 50 μm. The reduced-friction material is pressed into the fine recesses in the roughened tube surface by the operational load which strengthens the long-term adhesion of the slide coating on the guide tube.

Important advantages of the lifting jack arrangement according to the invention are excellent sliding properties and high wear resistance of the paired sliding surfaces. For realizing optimum sliding properties, special sliding elements consisting of a relatively hard, macromolecular synthetic material such as hard polyethylene (for example, PE1000) are used which have a sufficiently high strength and do not damage the slide coating of the guide tube which contains PTFE. Due to the elevated temperature and the pressure stresses, the PTFE components are fixedly embedded in the fine recesses and molecular cavities of the roughened tube surface so that stable sliding and emergency running properties can be obtained, even if a major part of the friction coating has been abraded by movements of the guide tube.

BRIEF DESCRIPTION OF THE DRAWING

Further particularities and advantages of the invention will become clear from the following description of preferred embodiments with reference to the drawing, in which the single FIGURE.

DETAILED DESCRIPTION OF THE PREFERRED EMBODIMENT

Figure 1:
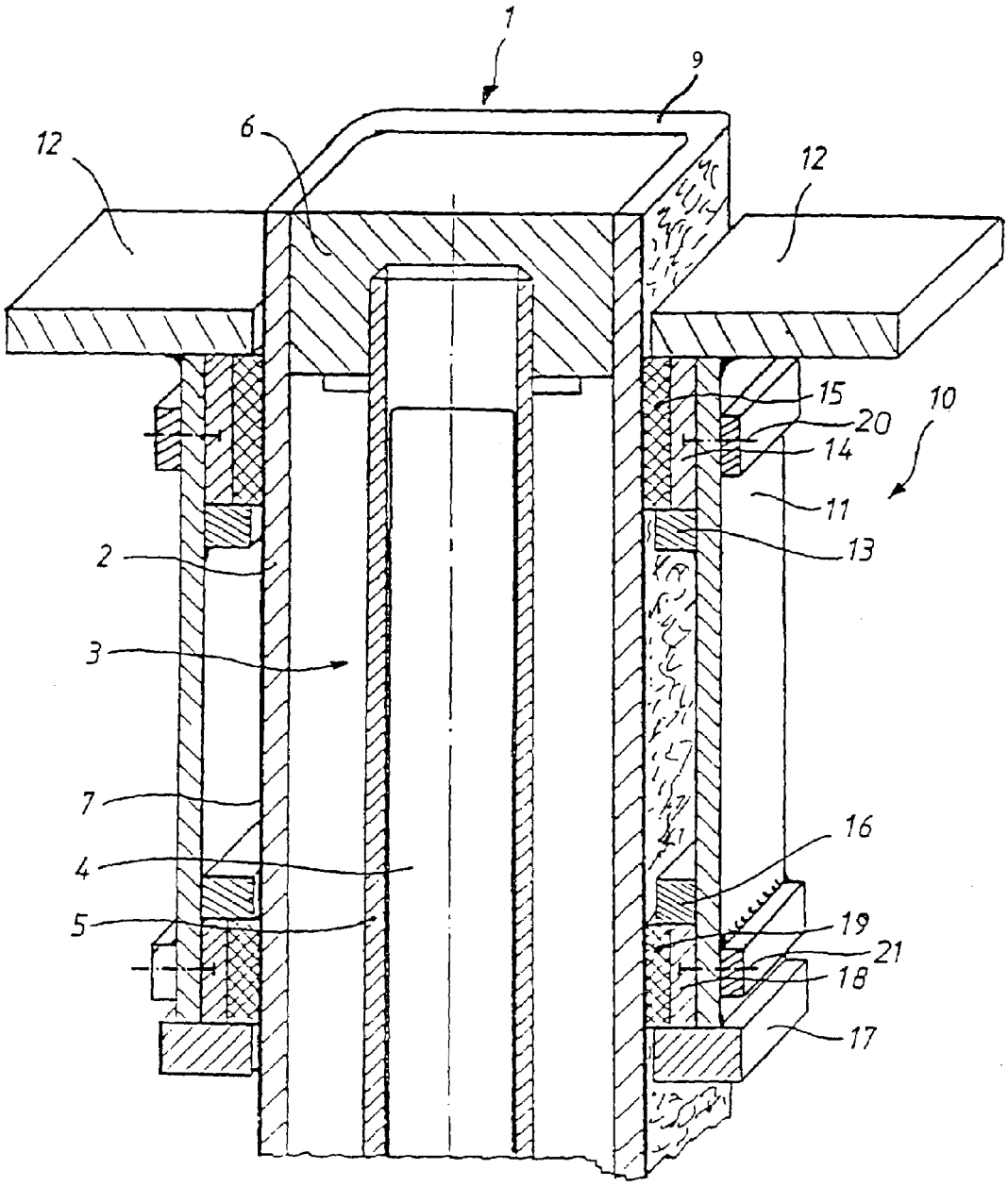
FIG. 1, is a cross-sectional view of the lifting jack arrangement of the present invention.

In the following an embodiment of the lifting jack arrangement according to the invention will be described with reference to the schematic cross-sectional view in the figure. The drawing is an axial cross-sectional view schematically showing the upper part of lifting jack 1 comprising vertical guide tube 2, having top 9 and a quadratic cross-section in this case as well as piston/cylinder unit 3 coaxially assembled inside the guide tube as a lifting assembly. The piston/cylinder unit comprises stationary piston 4 attached to a lower base (not shown) and cylinder housing 5 vertically shiftable on the piston. The upper end of the cylinder housing is fixed in thick-walled plate element 6 fixedly connected to the end section of the guide tube. Reduced-friction and abrasion resistant slide coating 7 made of a synthetic material, for example, containing PTFE, is permanently and fixedly provided on the outer surface of the guide tube, which was roughened by a special treatment, for example sandblasting, and is absolutely free of contamination.

For applying the anti-friction layer, the outer surface of the guide tube is carefully cleaned and degreased and then sandblasted to roughen it. While avoiding all new contamination a lubricant film of PTFE is then applied to the roughened surface, for example, by spraying, and solidified by a heat treatment at about 230° C., preferably in an oven.

The lifting jack described above is guided in stationary guiding sleeve 10 which, in case of the shown embodiment, comprises a square guiding tube having either two or four diametrically opposed, dimensionally stable plates 11. The plates are permanently fixed to the bottom side of bearing bottom plate 12, for example, by welding. The bearing bottom plate is part of the support assembly of the lifting platform located in the floor of the vehicle maintenance and repair facility. In the upper end portion of each plate 11 are pressure plate 14 and inner plate-like sliding element 15, the inner contact surface of which forms paired sliding surfaces with slide coating 7 on the outer surface of guiding tube 2. The paired sliding surfaces are defined axially between bottom plate 12 and support bridge 13 welded to plate 11. In the shown embodiment comprising square guiding tube 2 preferably eight identical plate-shaped sliding elements 15—two sliding elements 15 for each side of the tube—are provided which each consist of a hard polyethylene material possibly containing filling materials.

At the lower end section of each plate 11 are mounted lower supporting bridge 16 and lowermost enforcement collar 17 for stabilizing the guiding sleeve. The purpose of the lower supporting bridge and the collar is to fix lower pressure plate 18 as well as two plate-shaped sliding elements 19. Lower sliding elements 19 consist of the same material as upper sliding elements 15 and are likewise provided in pairs on each side of the tube. For accurately fixing lower and upper sliding elements 15 and 19, as well as for adjusting the gap between the guide tube and respective sliding elements 15 and 19, upper and lower screws 20 and 21 (or other appropriate fastening means) are provided which are configured to apply a defined pressure to associated pressure plates 14 and 18 and to sliding elements 15 and 19 via the pressure plates.

For reasons of completeness the support arrangement for the devices to be lifted, particularly for different types of vehicles, which is typical for lifting platforms, is mounted on the upper portion of guide tube 2. These known devices form no part of the invention and are not shown.

The invention is not limited to the illustrated embodiment but includes various variations of the details described above. For example sliding elements 15 and 19 need not be completely formed of the synthetic material but may be coated with a layer consisting of it and having a suitable wall thickness. These sliding elements can be positioned and fixed inside the guiding sleeve containing the tube section in another suitable manner. In addition, the guide tubes may have almost any cross-section, for example, polygonal, oval, or circular, and they may consist of any suitable sufficiently stiff and load-bearing material other than steel.

What is claimed is:

1. A lifting jack arrangement for lifting platforms comprising:

a liftable and lowerable, dimensionally stable guide tube having an upper end configured to include support elements for supporting a motor vehicle, wherein the guide tube is coated with a reduced-friction, abrasion resistant sliding layer, wherein the reduced-friction, abrasion resistant sliding layer comprises a fixedly adhering synthetic material containing PTFE; and a stationary guiding sleeve comprising sliding elements that are in contact with the guide tube.

2. The lifting jack arrangement of claim 1, wherein the sliding elements comprise a dimensionally stable hard material on a polyamide or a polyethylene basis.

3. The lifting jack arrangement of claim 2, wherein the guide tube consists of steel and the sliding layer is permanently and fixedly connected to a cleaned and roughened surface of the guide tube after a heat treatment.

4. The lifting jack arrangement of claim 3, wherein the sliding layer has a thickness of about 10 μm to about 50 μm.

5. The lifting jack arrangement of claim 3, wherein the guide tube is selected from the group consisting of a cross-section which is circular, oval and polygonal.

6. The lifting jack arrangement of claim 5, wherein the guide tube has a circular cross-section and the sliding elements are ring-shaped.

7. The lifting jack arrangement of claim 5, wherein the guide tube has a polygonal cross-section and the sliding elements are plate shaped.

8. The lifting jack arrangement of claim 1, wherein the guide tube consists of steel and the sliding layer is permanently and fixedly connected to a cleaned and roughened surface of the guide tube after a heat treatment.

9. The lifting jack arrangement of claim 1, wherein, the sliding layer has a thickness of about 10 μm to about 50 μm.

10. The lifting jack arrangement of claim 1, wherein the sliding layer has a thickness of about 10 μm to about 50 μm.

11. The lifting jack arrangement of claim 1, wherein the guide tube is selected from the group consisting of a cross-section which is circular, oval and polygonal.

12. The lifting jack arrangement of claim 1, wherein the sliding elements are fixed to an inner side of the guiding sleeve.

13. A lifting jack arrangement for lifting platforms comprising:

a liftable and lowerable, dimensionally stable guide tube having an upper end configured to include support elements for supporting a motor vehicle, wherein the guide tube is coated with a reduced-friction, abrasion resistant sliding layer, wherein the reduced-friction, abrasion resistant sliding layer comprises a fixedly adhering synthetic material containing PTFE;

a stationary guiding sleeve comprising sliding elements that are in contact with the guide tube; and a driving unit comprising at least one hydraulic piston/cylinder unit disposed inside or outside of the guide tube, said hydraulic piston/cylinder unit further comprising a stationary piston rod and a liftable and lowerable cylinder housing, said stationary rod being supported by a lower base and the liftable and lowerable cylinder housing of said piston/cylinder unit being fixedly connected to the upper end of the guide tube via a massive plate element.

14. The lifting jack arrangement of claim 13, wherein the sliding elements comprise a dimensionally stable hard material on a polyamide or a polyethylene basis.

15. The lifting jack arrangement of claim 13, wherein, the sliding layer has a thickness of about 10μm to about 50 μm.

16. The lifting jack arrangement of claim 13, wherein the guide tube is selected from the group consisting of a cross-section which is circular, oval and polygonal.

* * * * *